United States Patent [19]

Laud

[11] Patent Number: 4,772,876

[45] Date of Patent: Sep. 20, 1988

[54] REMOTE SECURITY TRANSMITTER ADDRESS PROGRAMMER

[75] Inventor: Timothy G. Laud, Mundelein, Ill.

[73] Assignee: Zenith Electronics Corporation, Glenview, Ill.

[21] Appl. No.: 917,636

[22] Filed: Oct. 10, 1986

[51] Int. Cl.[4] ..... G08B 1/08

[52] U.S. Cl. ..... 340/539; 340/506; 340/531

[58] Field of Search ..... 340/539, 506, 505, 518, 340/531

[56] References Cited

U.S. PATENT DOCUMENTS

| | | | |
|---|---|---|---|
| 4,228,424 | 10/1980 | LeNay et al. | 340/506 |
| 4,465,904 | 8/1984 | Gottsegen et al. | 340/518 |
| 4,581,606 | 4/1986 | Mallory | 340/518 |
| 4,652,860 | 3/1987 | Weishaupt et al. | 340/539 |

OTHER PUBLICATIONS

Brochure published by UniWatch, Inc., A United Telecom Company, entitled "Introducing the UniWatch 1 Total Protection System".

*Primary Examiner*—Donnie L. Crosland

[57] ABSTRACT

In a home security system, a microprocessor-based controller is responsive to user initiated keyboard entries for programming a plurality of remote sensors via a serial data link with sensor-unique data such as a sensor identification number and a house identification number. The thus programmed sensor may then be disconnected from and remotely located with respect to the controller for providing alert signals via an RF link to the controller upon triggering of the sensor. The programming data is also stored in the controller as well as in a central station to which a plurality of home-based controllers are coupled to provide the security system with a high degree of reliability.

7 Claims, 1 Drawing Sheet

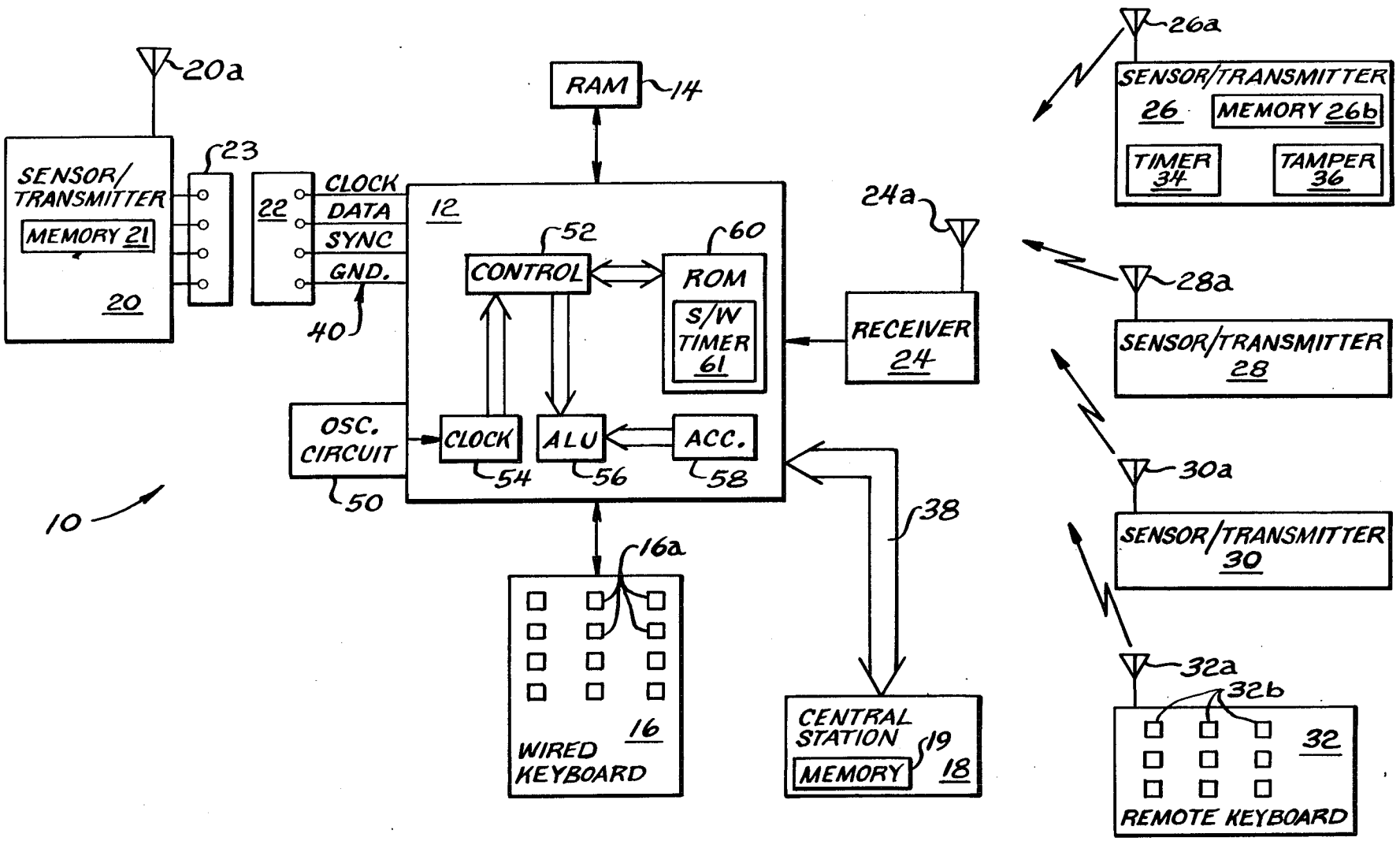
SENSOR/TRANSMITTER
26
MEMORY 26b
TIMER 34
TAMPER 36
26a
SENSOR/TRANSMITTER 28
28a
SENSOR/TRANSMITTER 30
30a
32
32a
32b
REMOTE KEYBOARD
RECEIVER 24
24a
38
CENTRAL STATION 18
19
MEMORY
RAM
14
ROM
S/W TIMER 61
60
ACC.
58
CONTROL
52
ALU
56
CLOCK
54
12
16a
16
WIRED KEYBOARD
CLOCK
DATA
SYNC
GND.
40
OSC. CIRCUIT
50
22
23
20a
SENSOR/ TRANSMITTER
MEMORY 21
20
10

REMOTE SECURITY TRANSMITTER ADDRESS PROGRAMMER

BACKGROUND OF THE INVENTION

This invention relates generally to security systems and is particularly directed to the programming of a plurality of remote sensors in a microprocessor-based security system.

Security systems are gaining ever increasing acceptance in a greater variety of environments. While initially limited to government and industrial installations, security systems can now commonly be found in the home. Regardless of the application or environment, the typical security system includes a master controller coupled and responsive to one or more sensors. The sensors may provide an intrusion alert, a fire alarm, movement detection information, or other information relating to the environment being monitored. The remote sensors may be either hard wired to the controller or may be coupled to the controller via an RF link. Other approaches may make use of ultrasonic or infrared signals transmitted from the sensor to the controller. The controller may either provide an alert signal at the location being monitored or may be coupled to a remote central station, such as a police or fire station. Sensor information received by the controller may be provided to the central station via an RF link or a conventional telephone line. It has also been proposed to integrate the security system with a cable television (CATV) network, wherein the distribution cable is used to transmit CATV programming as well as security system status information.

Due to the widespread availability and acceptance of home security systems, the unique identification of sensors as well as controllers in each individual security system is necessary. For example, where RF links are used in neighboring houses to convey remote sensor information to a respective controller in each of the houses with a common frequency used by both systems as is generally the case, each of the sensors as well as each set of sensors in each of the houses must be assigned a unique identifier to enable each controller to not only respond to only those sensors which form part of its security system, but also to permit the controller to identify and distinguish between each individual sensor within its system.

Prior art multi-sensor security systems having a common controller generally make use of dual-inline-packaged (DIP) switches for assigning each remote sensor and controller a unique identifying address. This addressing arrangement represents a binary approach wherein each individual switch is either set or not set and corresponds to either a 1 or a 0 in a multi-bit address byte. This approach further requires the programmer, typically a home owner installing the system, to set the correct binary code in each sensor which uniquely identifies that sensor and in the controller which enables it to respond to only those sensors with which it is associated and to ignore RF signals emanating from remote sensors within other home security systems.

The setting of linear arrays of DIP switches, while perhaps routine to the technician skilled in the art, is frequently beyond the capability of the typical layman unfamiliar with electronic switching and coding arrangements. In addition, the DIP switches, which may number as many as 16 in a linear array, are not susceptible to miniaturization and thus limit the extent to which sensor size may be reduced. This is a critical consideration where it is desirable to minimize sensor size in reducing the possibility of sensor detection which is generally the case in most security systems. Finally, in addition to the relatively high cost of these DIP switches, the prior art approach requires each remote sensor as well as the controller to be individually programmed with a unique address which further complicates and increases the time required for initial sensor system set-up and also makes re-programming of the various security system components more difficult when it is necessary to change component identifier addresses.

The present invention overcomes the aforementioned limitations of the prior art by providing a microprocessorbased remote security transmitter address programmer which is responsive to user-initiated keyboard entries for simultaneously programming a security system controller and a sensor coupled thereto with addresses for uniquely identifying the controller as well as a plurality of such remote sensors which comprise the security system. The address programmer arrangement of the present invention allows for a reduction in remote sensor size and cost, simplifies the address programming procedure to permit even the unskilled to easily encode security system components, and enhances the reliability of the security system.

OBJECTS OF THE INVENTION

Accordingly, it is an object of the present invention to provide an improved security system having a plurality of sensors remotely located from a system controller.

It is another object of the present invention to provide an improved arrangement for the programming of a plurality of security system sensors, each having a unique identifying address, function and location.

Yet another object of the present invention is to provide an improved approach to the individual programming of a plurality of uniquely identified security system sensors.

A further object of the present invention is to improve the reliability and security of a detection system comprised of a master controller and a plurality of remotely located sensors.

BRIEF DESCRIPTION OF THE DRAWING

The appended claims set forth those novel features which characterize the invention. However, the invention itself, as well as further objects and advantages thereof, will best be understood by reference to the following detailed description of a preferred embodiment taken in conjunction with the accompanying drawing wherein is illustrated in simplified schematic and block diagram form a remote security transmitter programming system in accordance with the principles of the present invention.

DETAILED DESCRIPTION OF THE PREFERRED EMBODIMENT

Referring to the FIGURE, there is shown in simplified schematic and block diagram form a remote security transmitter programming system 10 in accordance with the present invention.

The security transmitter programming system 10 includes a microprocessor controller 12 which is coupled to a first, wired keyboard 16 and is responsive to various signals output therefrom corresponding to user-initiated engagement of the various keys 16*a* thereon. The keyboard 16 is coupled to the microprocessor 12 and receives various scanning signals therefrom to allow the microprocessor to detect engagement of the various keys 16*a* on the keyboard. The keys 16*a* represent various alphanumeric characters and are used to provide a coded address to the microprocessor 12 for programming the microprocessor and a sensor/transmitter 20 coupled thereto with unique identifying addressess in a manner described in detail below.

The microprocessor 12 may be conventional in design, with the 8031 microprocessor utilized in a preferred embodiment of the security transmitter programming system 10 of the present invention. The microprocessor 12 includes a controller 52, a clock 54, an arithmetic and logic unit (ALU) 56, an accumulator 58, and a read only memory (ROM) 60. The microprocessor 12 stores instructions and data, periodically updates the stored data, compares both stored and real-time data and makes decisions based upon these comparisons by means of logic instructions stored in its ROM 60 in providing control over the security transmitter programming system 10. The ROM 30 is a programmable, nonvolatile, factory produced memory matrix which includes a plurality of memory locations or "bytes" of 8 bits each.

An external crystal oscillator circuit 50 provides timing signals to the clock 54 of the integrated circuit (IC) microprocessor 12 for controlling the timing of operations carried out by the microprocessor. Microprocessor controller 52 is responsive to instructions read from the ROM 60 and directs the ALU 56 to perform various arithmetic operations in accordance with these instructions with respect to data stored in a random access memory (RAM) 14 coupled to the microprocessor 12 and to real-time data provided to the microprocessor from either the wired keyboard 16, a central station 18, a receiver 24, or a remote keyboard 32. The operation of these various sources of input signals to the microprocessor controller 12 and the manner in which they interface with the microprocessor is discussed below. Data from these various control signal sources is provided via the microprocessor's accumulator 58 to the ALU 56 and, based upon comparison of these various real-time inputs to the microprocessor with data read from the RAM 14, the microprocessor 12 performs various functions and generates various output signals as described below.

Included in the security transmitter programming system 10 are a plurality of sensors/transmitters 20, 26, 28 and 30 each of which includes a respective antenna 20*a*, 26*a*, 28*a* and 30*a*. Each of the sensors/transmitters is remotely located from the microprocessor 12 and typically provides information to the controller regarding a sensed parameter in the room or area being monitored. For example, one of the sensor/transmitters may provide an intrusion alarm for the room in which it is located, while another sensor/transmitter may provide a fire warning for that same room. Similarly, each of the sensor/transmitters may be located in a different area or room to provide an alarm for the same type of emergency situation as detected in each of the various rooms. In a preferred embodiment, the sensors/transmitters all transmit at a common frequency of 300 MHz.

Each sensor/transmitter also includes a status timer 34 and a tamper sensor 36, although a status timer and a tamper sensor are only shown for sensor/transmitter 26 in the Figure for simplicity. A status timer 34 counts a predetermined time interval in each of the sensors/transmitters and outputs a status signal to the receiver 24. The receiver 24 includes an antenna 24*a* by means of which the status signals output by the sensor/transmitters 20, 26, 28 and 30 are provided to the receiver which, in turn, provides to the microprocessor 12 signals corresponding to the aforementioned status signals. The microprocessor 12 includes a timer in the form of a software timing routine 61 in the operating program stored in the microprocessor's ROM 60. If the output of the timer 34 of a given sensor/transmitter is not received within a predetermined time interval as determined by the microprocessor's software timer 61, the microprocessor 12 outputs an alert signal to the central station 18 as well as locally indicating an abnormal operating condition in the sensor/transmitter from which the expected timer status signal should have been received. A tamper sensor 36 within each of the sensors/transmitters provides an alert signal to the receiver 24 in the event the sensor/transmitter is tampered with or subject to unusual or unauthorized manipulation. In addition, synchronization and timing between the receiver 24 and the various sensors/transmitters 26, 28 and 30 is accomplished by means of the software timer routine 61 stored within the microprocessor's ROM 60. The various alarm signals which may be transmitted by any of the sensors/transmitters 26, 28 and 30 are retransmitted for several cycles in order to ensure receiver receipt and detection of the alarm signal where more than one sensor-transmitter outputs an alarm signal at a given time. Repetitive transmission of an alarm signal by a sensor/transmitter increases system reliability by increasing the likelihood of the alarm signal getting through where more than one alarm signal may be provided to the receiver at a given time in the nonsynchronous transmission of alarm signals.

In accordance with the present invention, microprocessor 12 is responsive to user-initiated inputs to the wired keyboard 16 coupled thereto for programming a sensor/transmitter 20 with individual address information. Thus, various combinations of alphanumic characters may be entered via the keys 16*a* on the wired keyboard 16 and converted to corresponding digital signals which are provided to a sensor/transmitter 20 coupled to the microprocessor 12 via a serial data link 40 in providing the sensor/transmitter with a unique identifying address. In a preferred embodiment, the serial data link 40 is coupled to a first connector member 22, while the sensor/transmitter 20 is coupled to a second connector member 23. The first and second connector members 22, 23 form a plug-in combination by means of which the sensor/transmitter 20 may be coupled to the microprocessor 12 for receiving various outputs therefrom. As shown in the Figure, these outputs provided via the serial data link 40 include a clock signal, addressing data, a synchronization (sync) signal and a ground connection. The clock and synchronization signals provide a common time base for the microprocessor 12 and the various sensors/transmitters 20, 26, 28 and 30 in the security system. The address data is stored within a memory 21 within the sensor/transmitter 20 and is subsequently transmitted back to the receiver 24 after the sensor/transmitter is disconnected from the microprocessor 12 and positioned in its intended location. It is in this manner that each of the sensors/transmitters 20, 26, 28 and 30 is uniquely identifiable by the microprocessor 12 which compares the received identifying address of the transmitting sensor/transmitter with those addresses previously stored in RAM 14. A positive comparison of an address stored in RAM 14 with the received address of one of the sensors/transmitters permits the microprocessor 12 to identify each individual sensor/transmitter and to process the received data accordingly.

Also in accordance with the present invention, address information entered via the wired keyboard 16 and stored in RAM 14 for local use by the microprocessor 12 is also provided via a two-way communications line 38 to the central station 18. The central station 18 also includes a memory 19 for storing microprocessor and sensor/transmitter addresses. In the event of loss of data stored in the RAM 14, the microprocessor 12 provides an appropriate signal indicating the loss of such data via the two-way communications line 38 to the central station 18. In response to receipt of this signal, the central station 18 reads the microprocessor address and the various sensor/transmitter addresses associated therewith from the memory 19 and provides this address data to the microprocessor 12 via the two-way communications line 38. Upon receipt of this address data from the central station 18, the microprocessor 12 again stores this address information within the RAM 14 for subsequent identification and verification of the various sensors/transmitters in the security system with which it is associated. Each of the sensors/transmitters 20, 26, 28 and 30 may then be coupled to the microprocessor 12 via the combination of first and second connector members 22, 23 and the serial data link 40 for again programming each of the sensors/transmitters with their respective unique identifying address in the event this data had earlier been lost.

The security transmitter programming system 10 further includes a remote keyboard 32 having an antenna 32*a* and a plurality of user selectable keys 32*b*. As in the case of the sensors/transmitters 26, 28 and 30, the remote keyboard/transmitter 32 is coupled to the receiver 24 via an RF link and permits various user initiated inputs to be provided to the security transmitter programming system 10. These inputs may include various instant alert commands such as a fire alarm, a medical emergency alert, or a police call which are immediately relayed via the microprocessor 12 to the central station 18. Various other control inputs may be provided via the remote keyboard/transmitter 32 such as a system test signal, as well as system arm and disarm commands for respectively activating or deactivating the security transmitter programming system.

In one embodiment of the present invention, the programming data provided via the microprocessor 12 from user entries on the wired keyboard 16 to the sensor/transmitter 20 includes an 8-bit house address followed by an 8-bit sensor address which uniquely identifies a given sensor/transmitter. These two inputs are stored in the sensor/transmitter's memory 21 for subsequent recall therefrom to permit the sensor/transmitter to uniquely identify itself to the microprocessor 12. Each sensor/transmitter transmitter would typically also include a microprocessor for processing the various signals provided thereto and output therefrom although such is not shown in the Figure for simplicity. Each of the sensors/transmitter 26, 28 and 30 provides three bytes of information to the receiver 24 for processing by the microprocessor 12. Each byte is comprised of 8-bits and respectively includes a house address, a sensor/transmitter address, and sensor status information. The first two bytes of information uniquely identify the sensor/transmitter, while the last byte provides sensory information relating to the status of the location or environment under surveillance.

There has thus been shown a security transmitter programming system which permits a security system microprocessor controller as well as a plurality of remote sensor/transmitter units to be programmed with a unique identifying address by means of user initiated keyboard entries. The security transmitter programming system simplifies and expedites the address programming of these security system components by providing for the simultaneous programming of the microprocessor controller and a sensor/transmitter coupled thereto and eliminates the complexity, cost and large size requirements of prior art DIP switch addressing arrangements.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. In a security system including a plurality of remote sensors responsive to a sensory input from an area under surveillance for providing an RF detection signal representing said sensory input, an arrangement for identifying each of said remote sensors by means of an individual identifying address comprising:

an address memory in each of said plurality of remote sensors for storing an individual identifying address associated with its respective remote sensor;

keyboard input means for generating an individual identifying address;

first memory means for storing address data;

control means coupled to said memory means and to a remote sensor and said keyboard input means and responsive to an identifying address output from said keyboard input means for storing said identifying address in said first memory means and the address memory of a remote sensor and for subsequently comparing an address received from a remote sensor with said identifying addresses stored in said first memory means thereby uniquely identifying each of said remote sensors;

receiver means coupled to said control means and responsive to an RF detection signal from the remote sensors for providing said detection signal to said control means thereby uniquely identifying said one of the remote sensors; and a remote keyboard/transmitter responsive to user inputs for providing RF commands to said control means via said receiver means for exercising control over said security system.

2. The arrangement of claim 1 further comprising releasable coupling means for connecting said control means to a remote sensor for storing an identifying address therein and for facilitating subsequent decoupling of said control means and said remote sensor and the remote positioning of said sensor.

3. The arrangement of claim 2 further comprising a serial data link for connecting, in combination with said coupling means, said coupling means to a remote sensor for storing an identifying address thereon.

4. The arrangement of claim 1 further comprising a central station coupled to said control means by means of a data communications line, wherein said central station includes second memory means for storing said identifying addresses therein and, following loss of said identifying addresses from said first memory means, for providing the thus stored identifying addresses to said control means for storage again in said first memory means.

5. The arrangement of claim 1 wherein each of said remote sensors further includes a respective status timer for emitting a periodic RF status signal to said control means indicating normal operation of said remote sensor.

6. The arrangement of claim 1 wherein each of said remote sensors further includes a respective tamper sensor for emitting an alert signal to said control means indicating that its associated remote sensor has been tampered with.

7. The arrangement of claim 1 wherein said RF detection signal includes house address information, remote sensor address information, and sensor status information.

* * * * *